US005779397A

United States Patent [19]

Takemiya et al.

[11] Patent Number: 5,779,397

[45] Date of Patent: Jul. 14, 1998

[54] METHOD OF IMPROVING SOIL BODY AGAINST VIBRATION AND LIQUEFACTION

[76] Inventors: Hirokazu Takemiya, 15-23, Tsushima-honmachi; Tasuichirou Naruse, 136-1, Souzume; Mitsunori Hashimoto, 2-20, Tsushima-shino 2-chome, all of Okayama-shi, Okayama, Japan

[21] Appl. No.: 652,950

[22] Filed: May 24, 1996

[51] Int. Cl.[6] ..... E02D 3/02

[52] U.S. Cl. ..... 405/271; 405/258; 404/31

[58] Field of Search ..... 405/258, 271; 404/27, 31

[56] References Cited

U.S. PATENT DOCUMENTS 3,614,867 10/1971 Nieman ..... 405/271

FOREIGN PATENT DOCUMENTS 7-3829 1/1995 Japan .

*Primary Examiner*—Tamara L. Graysay
*Assistant Examiner*—Gary S. Hartmann
*Attorney, Agent, or Firm*—Merchant, Gould, Smith, Edell, Welter & Schmidt

[57] ABSTRACT

A method is provided for improving a soil body against vibration and liquefaction. According to the method, a higher strength stage is formed within the soil body, and a lower strength surface stage is formed above the higher strength stage. The higher strength stage includes a plurality of higher hardness portions formed by a consolidation process. Similarly, the lower strength stage includes a plurality of lower hardness portions also formed by a consolidation process in corresponding relation to the higher hardness portions.

6 Claims, 6 Drawing Sheets

METHOD OF IMPROVING SOIL BODY AGAINST VIBRATION AND LIQUEFACTION

BACKGROUND OF THE INVENTION

1. Field of the Invention

This invention relates to a method of improving a soil body against vibration and liquefaction particularly where the soil body is used to support a vibration receiving footing structure (e.g. a footing structure for a press machine) or a railway track for example.

2. Description of the Related Art

In recent years, vibration disturbances often occur due to vibration of machines and/or moving vehicles (traffic), and a countermeasure against such a problem is increasingly demanded. Particularly, in case where a pile foundation is used for a soft soil body, vibration is propagated into the soft soil body to adversely affect the nearby ground surface and may sometimes cause predominant vibration. Further, an earthquake or other vibration may cause liquefaction of a soft soil body to give great damages to the structure supported by the soil body, so that a countermeasure against soil liquefaction is also demanded.

One way for preventing vibration disturbances is to form a trench around a vibration receiving footing or foundation structure. However, since complete retention of the trench is impossible, it is necessary to use a provisional support such as timbering for retaining the trench, which may be detrimental to the vibration restraining effect of the trench. Further, the trenched portion of the ground is not available for useful purposes.

Another way for preventing vibration disturbances is to embed vertical rigid walls into the ground around a vibration receiving footing or foundation. However, such a countermeasure requires rearrangement of underground equipment such as water piping and therefore has a cost increase disadvantage.

In view of the above, the inventors of the present invention have previously proposed a vibration restraining method which utilizes a horizontal rigid block embedded in a soil body (see Japanese Patent Application Laid-open No. 7-3829 laid-open on Jan. 6, 1995). According to this method, specifically, a cement mixture is injected into the soil body at a certain depth from the soil surface to form a horizontal rigid block. The injection of the cement mixture may be performed by a mechanical agitation method wherein the cement mixture is injected for soil consolidation while a portion of the soil body is mechanically agitated, or by a high pressure injection method wherein the cement mixture is injected under high pressure.

The vibration restraining method utilizing a horizontal rigid block has been found more effective for vibration restriction than the prior art which utilizes vertical rigid walls. However, since the mechanical agitation used for forming the horizontal block inevitably need be performed from above the soil surface, the surface layer of the soil body above the horizontal block is inevitably agitated and thereby disturbed or loosened. Similarly, the high pressure injection also usable for forming the horizontal block also causes soil disturbance in the surface layer of the soil body due to the injection pressure. In either case, therefore, the disturbed or loosened surface layer of the soil body undergoes subsidence and provides a poor trafficability or support for the working vehicles.

SUMMARY OF THE INVENTION

It is, therefore, an object of the present invention to provide a method of improving a soil body against vibration and liquefaction without inviting the problem of disturbing and/or loosening the soil surface portion.

According to the present invention, there is provided a method of improving a soil body comprising the steps of: forming a higher strength stage within the soil body, the higher strength stage including a plurality of higher hardness portions formed by a consolidation process; and forming a lower strength surface stage above the higher strength stage, the lower strength stage including a plurality of lower hardness portions also formed by a consolidation process in corresponding relation to the higher hardness portions.

Normally, each of the higher hardness portions has a consolidation strength of not less than 10 $Kg/cm^2$ with a shear wave propagation velocity which is 3–5 times that of the surrounding soil, whereas each of the lower hardness portions has a consolidation strength of less than 10 $Kg/cm^2$.

For providing a sufficient restriction of vibration, the higher hardness portions as well as the lower hardness portions should preferably have an improvement area ratio of not less than 30% relative to the total bottom surface area of the footing structure supported by the soil body. Further, each of the lower hardness portions may preferably have a depth of not less than 1,000 mm, whereas each of the higher hardness portions may preferably have a depth of not less than 1,000 mm.

Each of the higher and lower hardness portions may be columnar. Further, the higher hardness portions as well as the lower hardness portions may be disposed in an annular arrangement if the soil body is made to support a pile foundation type footing structure.

The soil body to be improved by the method of the present invention may be a part of the ground. Alternatively, the soil body may be an embankment structure supported on the ground.

In case where the soil body is relatively soft and deep, the method of the present invention should further comprise the steps of: forming at least one additional higher strength stage below the first-mentioned higher strength stage, the additional higher strength stage including a plurality of higher hardness portions formed by a consolidation process; and forming at least one additional lower strength stage between the first-mentioned and additional higher strength stages, the additional lower strength stage including a plurality of lower hardness portions also formed by a consolidation process in corresponding relation to the higher hardness portions.

Other objects, features and advantages of the present invention will be fully understood from the following detailed description given with reference to the accompanying drawings.

DETAILED DESCRIPTION OF THE PREFERRED EMBODIMENTS

Figure 1:
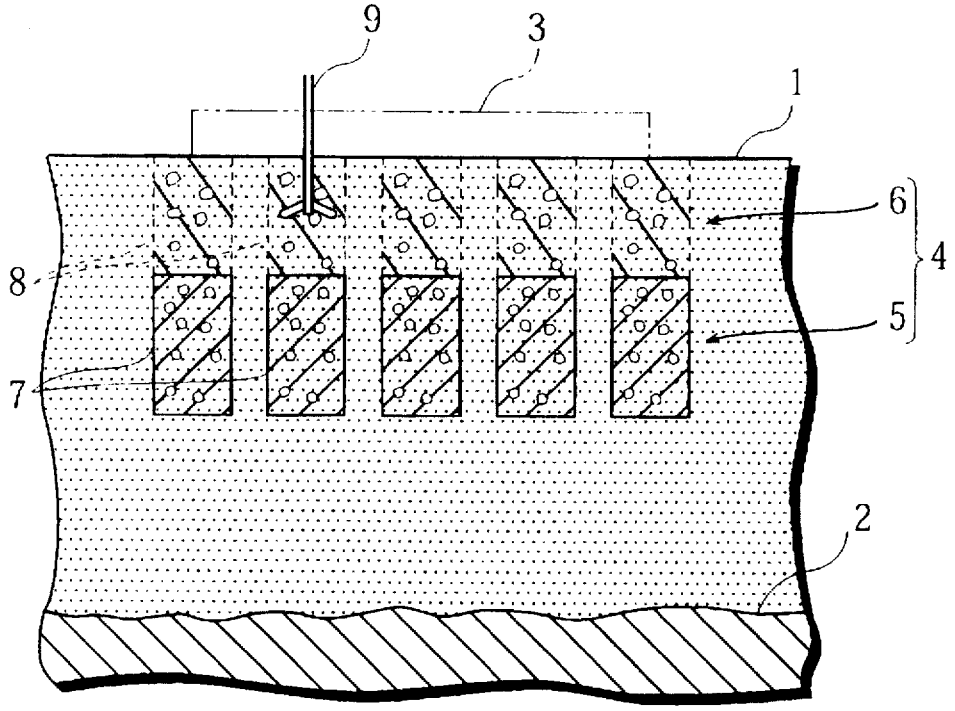
FIG. 1 is a view, in vertical section, showing an improved soil region treated by a method according to a first embodiment of the present invention.
Figure 2:
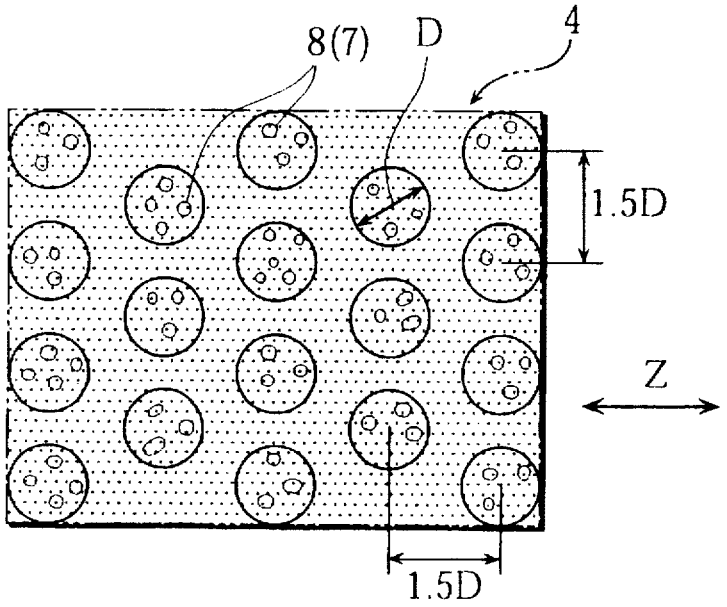
FIG. 2 is a plan view of the same improved soil region.

FIGS. 1 and 2 of the accompanying drawings illustrate a first embodiment of the present invention. In these figures, reference numeral 1 designates a soil body, whereas reference numeral 2 represents a foundation bed or bedrock. A footing structure 3 is supported on the soil body 1, and an improved soil region 4 is formed immediately under the footing structure 3 within the soil body 1.

According to the first embodiment, the improved soil region 4 is rectangular in plan view with a length of 5,600 mm and a width of 4,400 mm. The improved soil region 4 comprises a higher strength stage 5 and a lower strength surface stage 6 above the higher strength stage 5. In this embodiment, the higher strength stage 5 has a thickness of 1,500 mm, whereas the lower strength surface stage 6 has a thickness of 1,000 mm.

The higher strength stage 5 includes a plurality of higher hardness portions 7 (e.g. eighteen higher hardness portions 7) spaced from each other. Each higher hardness portion 7 may be formed by a consolidation process. In the first embodiment, the higher hardness portion 7 has a consolidation strength of 20–30 $Kg/cm^2$.

The lower strength surface stage 6 includes a plurality of lower hardness portions 8 (e.g. eighteen lower hardness portions 8) spaced from each other. Each lower hardness portion 8 may be formed by a consolidation process. In the first embodiment, the lower hardness portion 8 has a consolidation strength of less than 10 $Kg/cm^2$ to be generally equal to the surrounding soil hardness.

According to the first embodiment, the higher hardness portions 7 and the lower hardness portions 8 are columnar with a diameter D (see FIG. 2) of 800 mm and arranged uniformly with a center-to-center interval of 1,200 mm which is 1.5 D. Such an arrangement of the higher and lower hardness portions 7, 8 is effective for hindering lateral or horizontal propagation of vibration, as indicated by an double-headed arrow Z. In the first embodiment, the improved soil region 4 has an improvement area ratio of 35%. The improvement area ratio is defined as the ratio of the actually consolidated area relative to the bottom area of the footing structure 3.

Further, according to the first embodiment, each of the lower hardness portions 8 has a depth of 1,000 mm, whereas each of the higher hardness portions 7 has a depth of 1,500 mm. Thus, the thickness of the lower strength surface stage 6 is 1,000 mm, whereas the thickness of the higher strength stage 5 is 1,500 mm.

Examples of consolidation process include a mechanical agitation method and a high pressure injection method. In the mechanical agitation method, a portion of soil is mechanically agitated by rotary blades while a cement mixture or other fluid solidifying agent is injected. In the higher pressure injection method, a cement mixture or other fluid solidifying agent is injected under high pressure.

FIG. 1 shows an example of mechanical agitation method wherein a rotating shaft 9 having a plurality of agitation blades is inserted into the soil 1. The rotating shaft 9, which is tubular, is connected to a supply source of cement mixture (not shown). A portion of the soil 1 agitated by the agitation blades becomes first loose but is later consolidated upon solidification of the cement mixture. The consolidation strength of each higher hardness portion 7 or lower hardness portion 8 may be optionally set by adjusting the injection amount of cement mixture or by suitably selecting the composition of cement mixture.

For confirming the advantages of the present invention, a test place (soil) or ground is selected which has a soft viscous surface layer of 0.7–0.8 m with an N value of 0 and a gravel layer with an N value of 50 starting from a depth of about 12.0 m from the surface level. The N value represents the hardness of the soil and is defined as the number of hammer impacts required for driving a standard penetration test sampler into the soil by an amount of 30 cm when a hammer of 63.5 Kg is caused to gravitationally fall onto the sampler from a height of 75 cm. The test soil is treated for soil improvement in the manner illustrated in FIGS. 1 and 2.

To determine the vibration propagation characteristics of the improved test soil body 1, an impact receiving footing (not shown) is placed on the improved soil region 4 at a suitable location thereof, and a servo type velocity meter is also placed on the improved soil region 4 at a location (surface detection point) near the rectangular center thereof but spaced from the impact receiving footing. Vibration is applied to the test soil body 1 by causing a weight load (about 40 Kg) to impinge on the impact receiving footing, the weight load being mounted on the tip of a hinge arm having a length of about 70 cm. The servo type velocity meter is caused to detect the response speed at the detection point.

Figure 6:
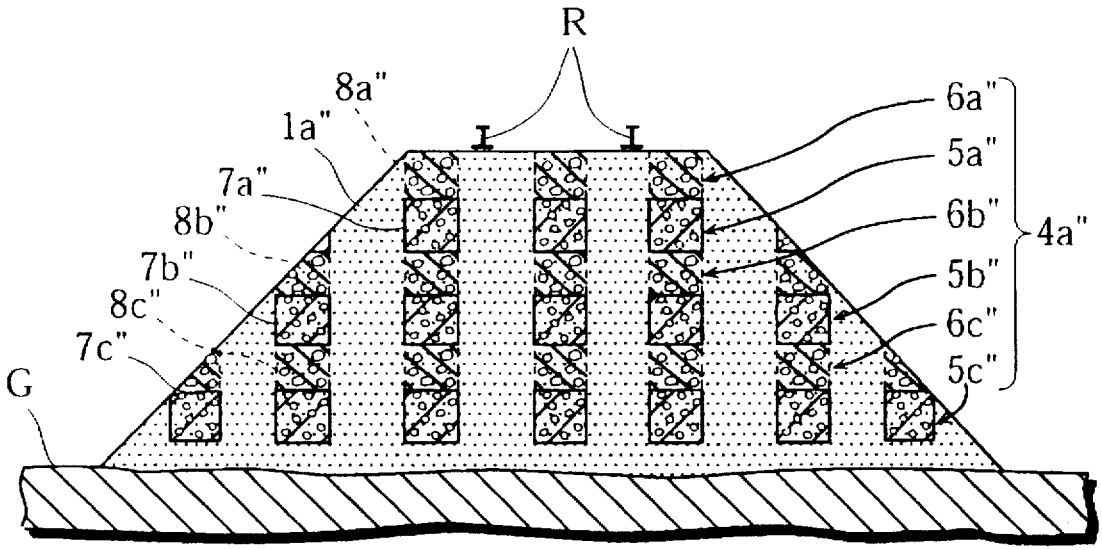
FIG. 6 is a view, in vertical section, showing an improved soil region treated by a method according to a fourth embodiment of the present invention.

FIG. 6 shows the vibration propagation characteristics obtained by the above-described test. In FIG. 6, the abscissa represents time (Unit: sec), whereas the ordinate represents vibration propagation velocity (Unit: cm/sec). Further, the lines A and B are propagation velocity attenuation curves of the test soil 1 after and before soil improvement, respectively.

Figure 7:
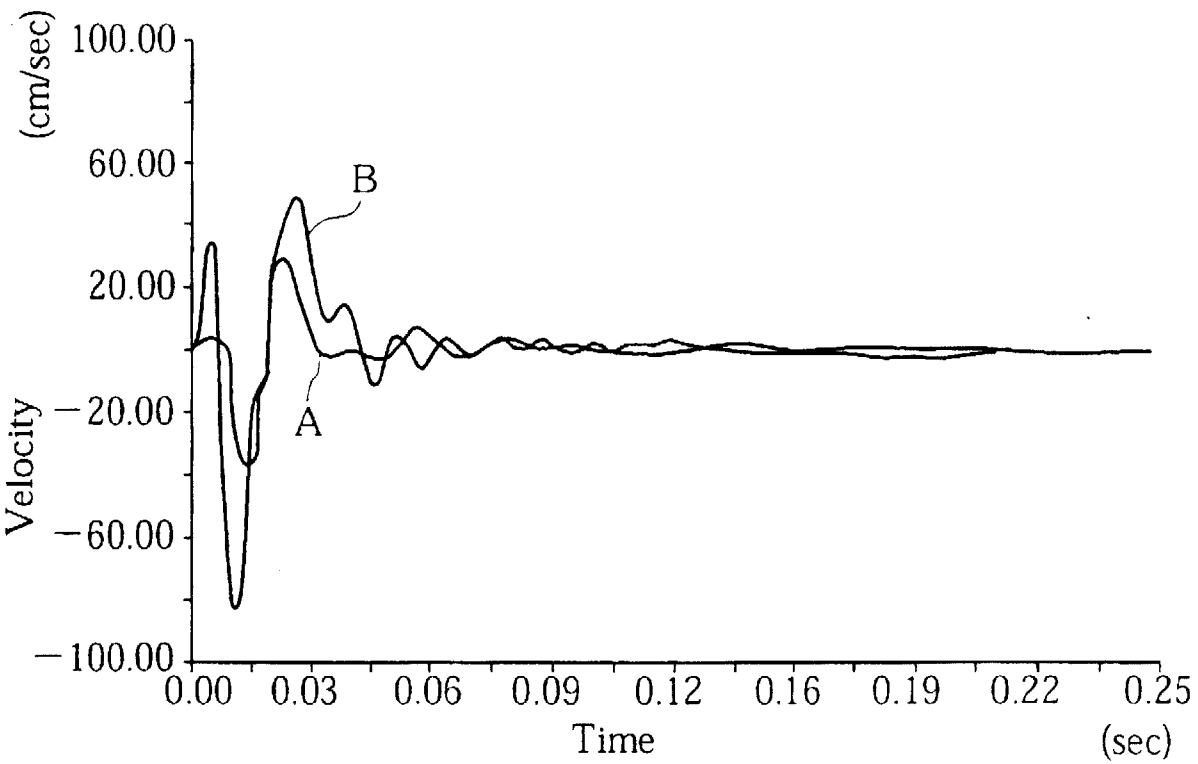
FIG. 7 is a graph showing the vibration propagation characteristics of the improved soil region illustrated in FIGS. 1 and 2.
Figure 8:
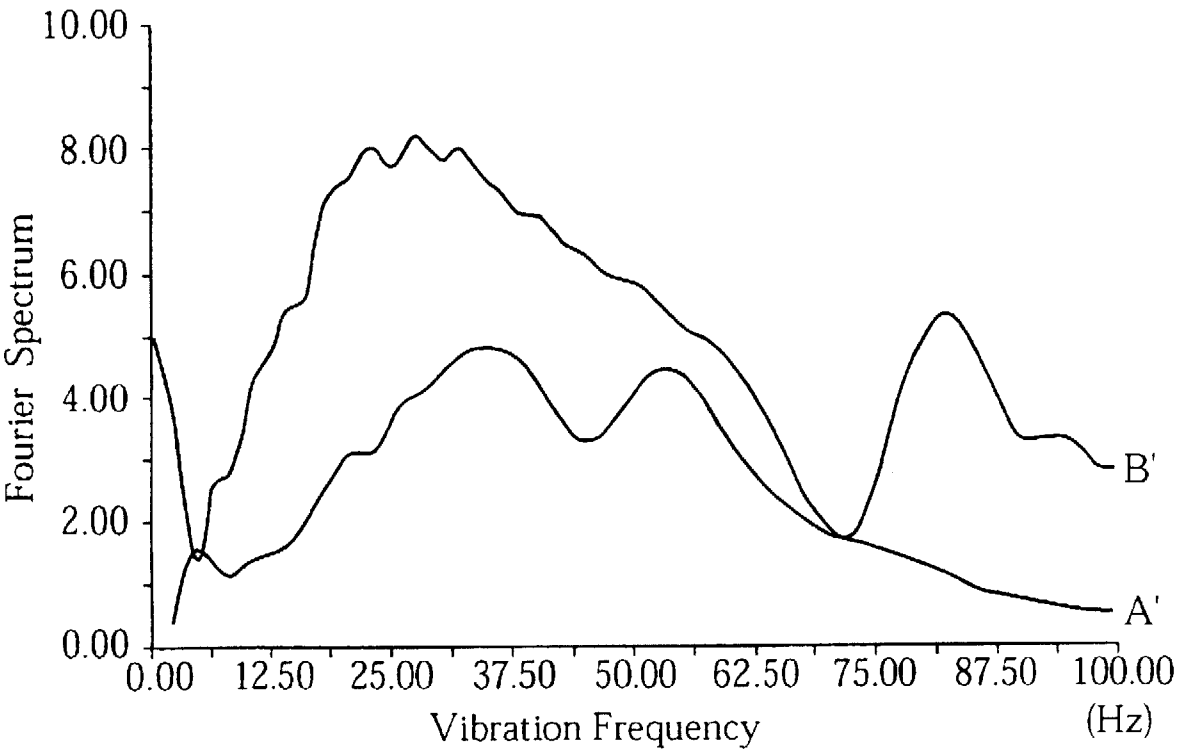
FIG. 8 is also a graph showing the vibration propagation characteristics of the same soil region expressed in a different way.

FIG. 7 also shows the vibration propagation characteristics obtained by the above-described test but expressed in a different way. In FIG. 7, the abscissa represents vibration frequency (Unit: Hz), whereas the ordinate represents Fourier spectrum. Further, the lines A' and B' are frequency distribution curves (expressed by Fourier spectrum) of the test soil 1 after and before soil improvement, respectively.

From FIGS. 6 and 7, it is concluded that the improved soil region 4 of the test soil body 1 restrains vibration by about 20–50% in comparison with the non-improved state of the test soil body.

According to the first embodiment, further, the lower strength surface stage 6 above the higher strength stage 5 includes the plurality of lower hardness portions 8 formed by a consolidation process. Though these lower hardness portions 8 are first loosened and disturbed by mechanical agitation, they are subsequently consolidated for removal of loosening and disturbance. Thus, the lower hardness portions 8 are prevented from undergoing surface subsidence and thereby provides a good trafficability.

Moreover, since the lower hardness portions 8 as well as the higher hardness portions 7 does not occupy the entire bottom area of the footing structure 3 (only assuming 35% in the first embodiment), it is possible to greatly reduce the cost and time required for performing the soil improvement process.

Figure 3:
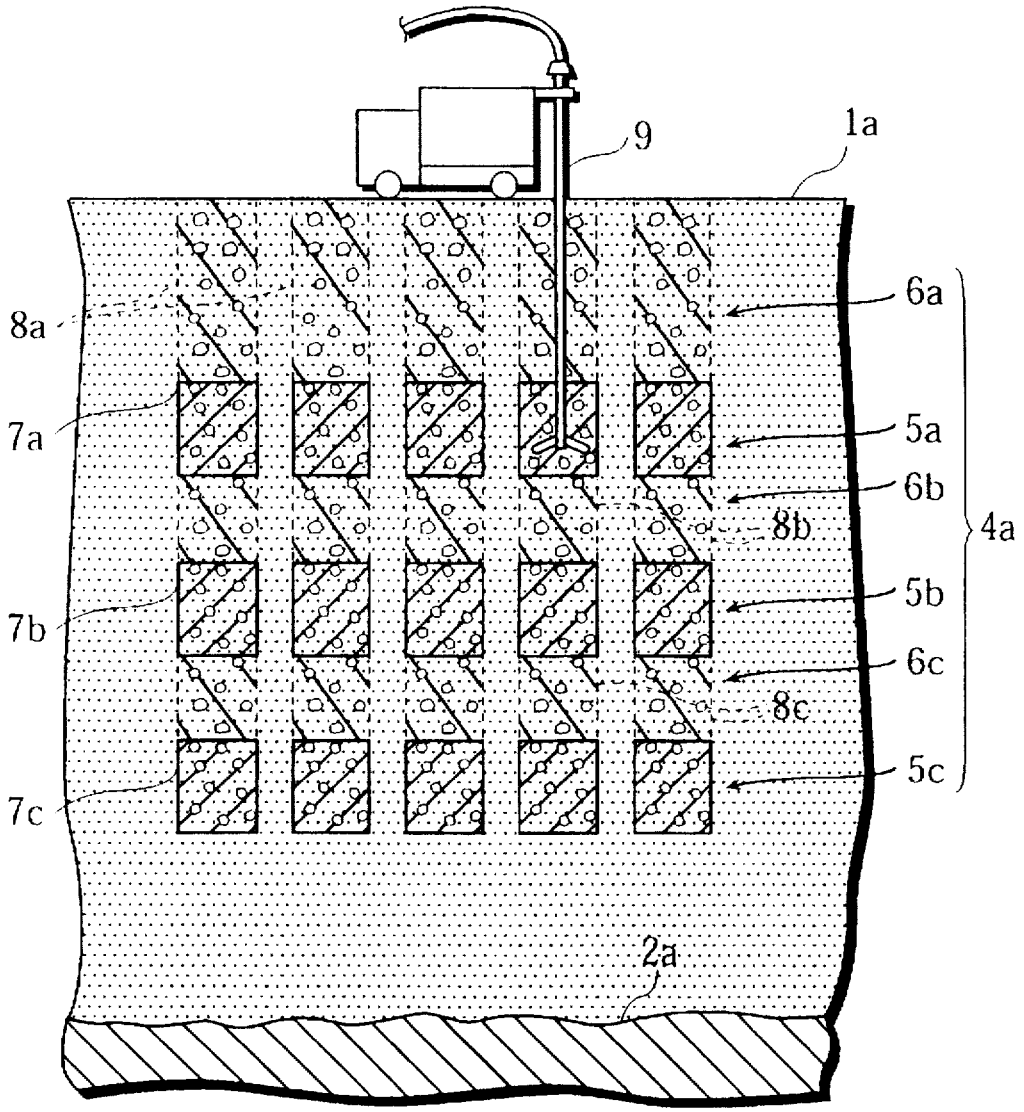
FIG. 3 is a view, in vertical section, showing an improved soil region treated by a method according to a second embodiment of the present invention.

FIG. 3 illustrates a second embodiment of the present invention. This embodiment is particularly suitable where a soil body 1a above a bedrock 2a has a relative large depth and is relative soft, requiring prevention of soil liquefaction at the event of an earthquake in addition to restriction of vibration.

Specifically, according to the second embodiment, the soil body 1a is made to have an improved soil region 4a which includes a first higher strength stage 5a, a second higher strength stage 5b below the first higher strength stage 5a, and a third higher strength stage 5c below the second higher strength stage 5b. The improved soil region 4a further includes a first lower strength stage 6a (surface stage) above the first higher strength stage 5a, a second lower strength stage 6b between the first and second higher strength stages 5a, 5b, and a third lower strength stage 6c between the second and third higher strength stages 5b, 5c.

Each of the higher strength stages 5a, 5b, 5c includes a plurality of column-like higher hardness portions 7a, 7b, 7c spaced from each other. Each higher hardness portion 7a, 7b, 7c may be formed by a consolidation process in the same manner as in the first embodiment. In the second embodiment, again, the higher hardness portion 7a, 7b, 7c has a consolidation strength of 20–30 $Kg/cm^2$.

Similarly, each of the lower strength surface stages 6a, 6b, 6c includes a plurality of column-like lower hardness portions 8a, 8b, 8c spaced from each other. Each lower hardness portion 8a, 8b, 8c may be formed by a consolidation process in the same manner as in the first embodiment and has a consolidation strength of less than 10 $Kg/cm^2$ to be generally equal to the surrounding soil hardness.

In the second embodiment, the first lower hardness portions 6a has a depth of about 1,100 mm, whereas each of the second and third lower hardness portions 6b, 6c has a depth of about 2,300 mm. Further, each of the first to third higher hardness portions 7a, 7b, 7c has a depth of about 1,200 mm.

According to the second embodiment, the first higher strength stage 5a limits or restrains vibration of the first lower strength stage 6a. Similarly, the second and third higher strength stages 5b, 5c limits vibration of the second and third lower strength stages 6b, 6c, respectively. Thus, the improved soil region 4a as a whole can work effectively for preventing soil liquefaction while also restraining lateral and vertical propagation of vibration. Of course, the number of the higher and lower strength stages may be optionally selected depending on the depth of the soil body 1a.

Figure 4:
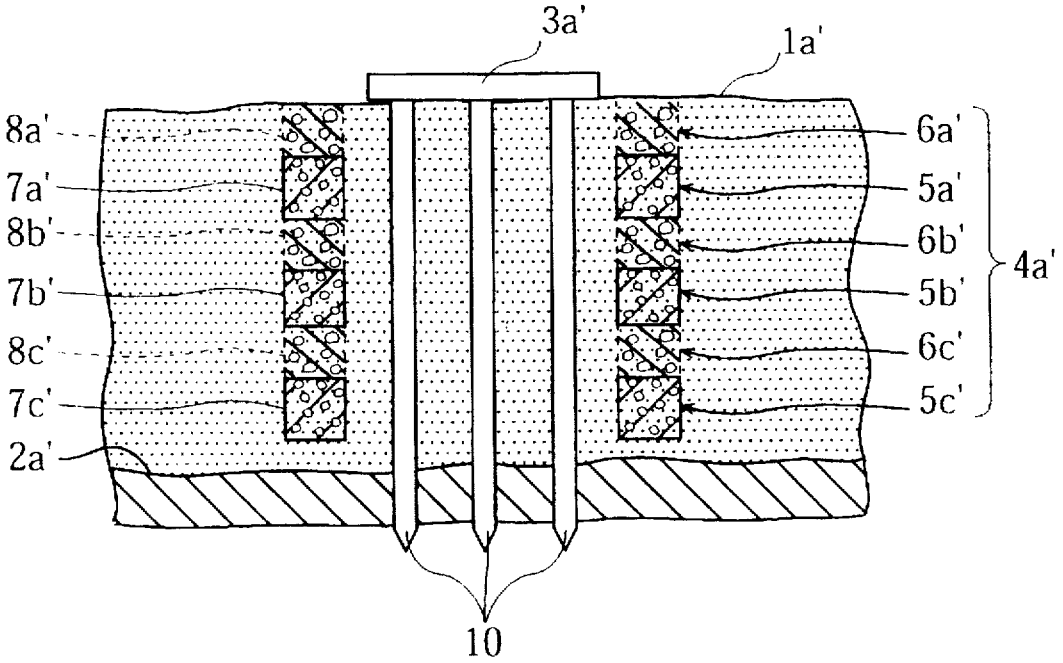
FIG. 4 is a view, in vertical section, showing an improved soil region treated by a method according to a third embodiment of the present invention.
Figure 5:
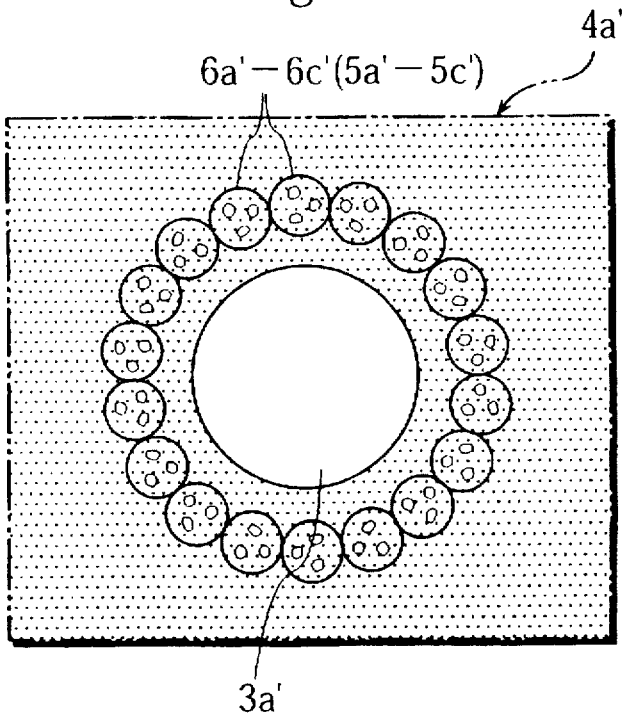
FIG. 5 is a plan view showing the improved soil region of FIG. 4.

FIGS. 4 and 5 illustrate a third embodiment of the present invention. This embodiment is suitable where a footing structure 3a' has a pile foundation 10. Similarly to the second embodiment, a soil body 1a' above a bedrock 2a' has a relative large depth and is relative soft, requiring prevention of soil liquefaction in addition to restriction of vibration.

Specifically, the soil body 1a' is made to have an improved soil region 4a' which includes a first higher strength stage 5a, a second higher strength stage 5a' below the first higher strength stage 5a', and a third higher strength stage 5c' below the second higher strength stage 5b'. The improved soil region 4a' further includes a first lower strength stage 6a'(surface stage) above the first higher strength stage 5a', a second lower strength stage 6b' between the first and second higher strength stages 5a', 5b', and a third lower strength stage 6c' between the second and third higher strength stages 5b', 5c'.

Each of the higher strength stages 5a', 5b', 5c' includes a plurality of column-like higher hardness portions 7a', 7b', 7c' disposed in an annular arrangement (see FIG. 5) and formed by a consolidation process in the same manner as in the first embodiment. Similarly, each of the lower strength surface stages 6a', 6b', 6c' includes a plurality of column-like lower hardness portions 8a', 8b', 8c' disposed in an annular arrangement and formed by a consolidation process in the same manner as in the first embodiment. Thus, the pile foundation 10 of the footing structure 3a' can be made to extend through the annulus defined by the respective stages 5a'–5c', 6a'–6c'.

FIG. 6 illustrates a fourth embodiment of the present invention. This embodiment is suitable where a soil body 1a" is an embankment structure supported on the ground G. Typically, such an embankment structure is used for supporting a railway track R or as a river bank.

According to the fourth embodiment, the soil body or embankment soil structure 1a" is made to have an improved soil region 4a" which includes a first higher strength stage 5a", a second higher strength stage 5b" below the first higher strength stage 5a", and a third higher strength stage 5c" below the second higher strength stage 5b". The improved soil region 4a" further includes a first lower strength stage 6a"(surface stage) above the first higher strength stage 5a", a second lower strength stage 6b" between the first and second higher strength stages 5a", 5b", and a third lower strength stage 6c" between the second and third higher strength stages 5b", 5c".

Each of the higher strength stages 5a", 5b", 5c" includes a plurality of column-like higher hardness portions 7a", 7b", 7c" spaced from each other and formed by a consolidation process in the same manner as in the first embodiment. Similarly, each of the lower strength surface stages 6a", 6b", 6c" includes a plurality of column-like lower hardness portions 8a", 8b", 8c" spaced from each other and formed by a consolidation process in the same manner as in the first embodiment.

The preferred embodiments of the present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

We claim:

1. A method of improving a soil body comprising the steps of:

forming a higher strength stage within the soil body, the higher strength stage including a plurality of higher hardness portions formed by a consolidation process at horizontally different positions in the same higher strength stage; and forming a lower strength surface stage above the higher strength stage, the lower strength stage including a plurality of lower hardness portions also formed by a consolidation process in corresponding relation to the higher hardness portions.

2. The method according to claim 1, wherein each of the higher and lower hardness portions is columnar.

3. The method according to claim 1, further comprising the steps of:

forming at least one additional higher strength stage below the first-mentioned higher strength stage, the additional higher strength stage including a plurality of higher hardness portions formed by a consolidation process; and forming at least one additional lower strength stage between the first-mentioned and additional higher strength stages, the additional lower strength stage including a plurality of lower hardness portions also formed by a consolidation process in corresponding relation to the higher hardness portions.

4. The method according to claim 1, wherein the higher hardness portions as well as the lower hardness portions are disposed in an annular arrangement.

5. The method according to claim 1, wherein the soil body is an embankment structure.

6. A method of improving a soil body comprising the steps of:

forming a higher strength stage within the soil body, the higher strength stage including a plurality of higher hardness portions formed by a consolidation process and spaced horizontally from each other in the same higher strength stage; and forming a lower strength surface stage above the higher strength stage, the lower strength stage including a plurality of lower hardness portions also formed by a consolidation process in corresponding relation to the higher hardness portions.

* * * * *